United States Patent [19]

Baena

[11] Patent Number: 4,998,393

[45] Date of Patent: Mar. 12, 1991

[54] CONSTRUCTION OF BUILDINGS

[76] Inventor: Juan A. M. Baena, Campo de Volantin, Bilbao, Spain, 8 48007

[21] Appl. No.: 407,728

[22] Filed: Sep. 11, 1989

Related U.S. Application Data

[63] Continuation of Ser. No. 211,583, Jun. 27, 1988, abandoned.

[30] Foreign Application Priority Data

Jul. 1, 1987 [ES] Spain ..... 8701926
Jan. 5, 1988 [ES] Spain ..... 8800011

[51] Int. Cl.[5] ..... E04B 2/40

[52] U.S. Cl. ..... 52/236.9; 52/258; 52/274; 52/275; 52/283; 52/295; 52/425; 52/584

[58] Field of Search ..... 249/192, 194, 196; 52/584, 127.11, 127.12, 127.7, 236.7, 236.6, 236.8, 426, 259, 425, 295, 259, 258, 562, 252, 236.9, 274, 275, 283, 425

[56] References Cited

U.S. PATENT DOCUMENTS

| | | | |
|---|---|---|---|
| 2,940,294 | 6/1960 | Carlson | 52/259 |
| 3,383,817 | 5/1968 | Gregori | 52/309.11 |
| 3,691,708 | 9/1972 | Firnkas | 52/259 |
| 3,710,527 | 1/1973 | Farebrother | 52/259 |
| 3,835,608 | 9/1974 | Johnson | 52/426 |
| 4,133,156 | 1/1979 | Unger | 52/426 |
| 4,336,676 | 6/1982 | Artzea | 52/309.11 |
| 4,433,520 | 2/1984 | Maschoff | 52/426 |
| 4,461,130 | 7/1984 | Shubow | 52/236.6 |
| 4,516,372 | 5/1985 | Grutsch | 52/426 |
| 4,669,240 | 6/1987 | Amormino | 52/259 |
| 4,697,398 | 10/1987 | Grainieri | 52/236.8 |
| 4,700,523 | 10/1987 | Kohara | 52/426 |
| 4,742,659 | 5/1988 | Meiller | 52/426 |
| 4,864,792 | 9/1989 | Andre | 52/426 |

*Primary Examiner*—John E. Murtagh
*Attorney, Agent, or Firm*—Helfgott & Karas

[57] ABSTRACT

Improvements in the construction of buildings is described using prefabricated panels provided with insulation material arranged in pairs. Couplying structure secures the panels to a base and to other panels. Concrete fills the hollow space between the pair of panels.

5 Claims, 9 Drawing Sheets

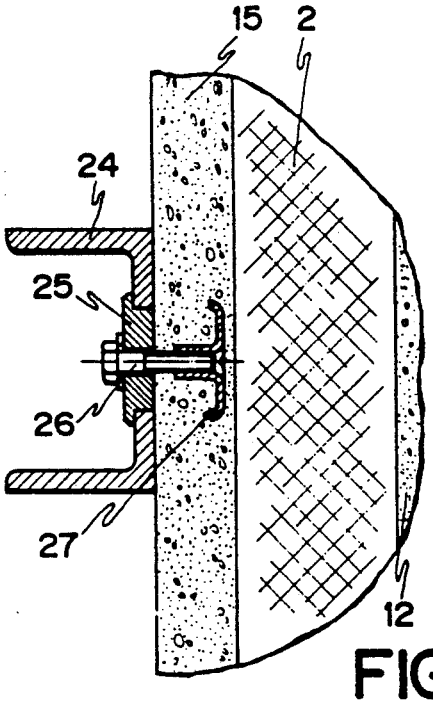
FIG.-7
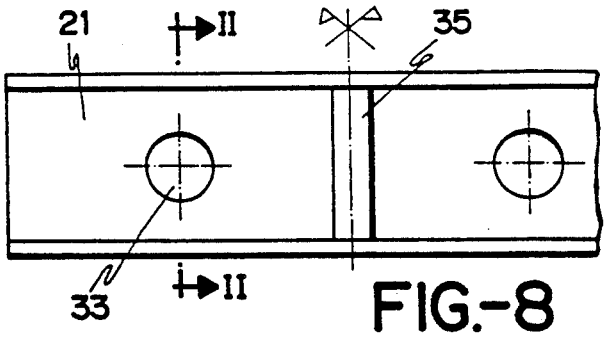
FIG.-8
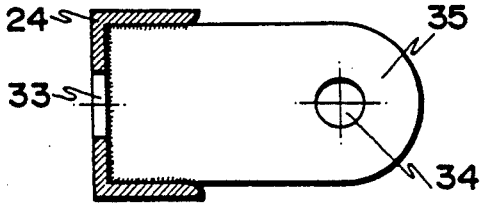
FIG.-9
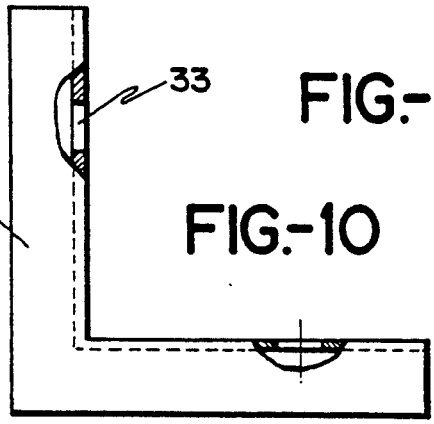
FIG.-10
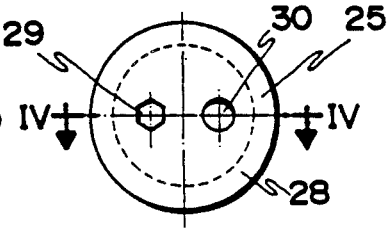
FIG.-13
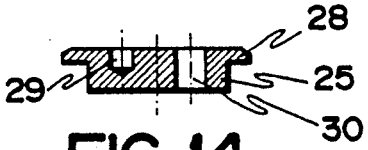
FIG.-14
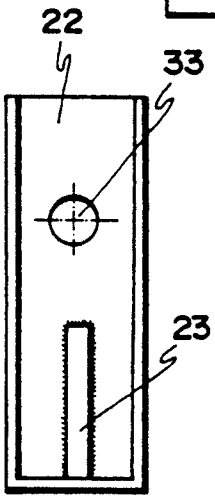
FIG.-11
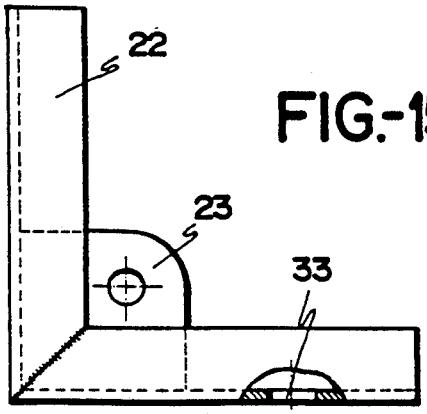
FIG.-12
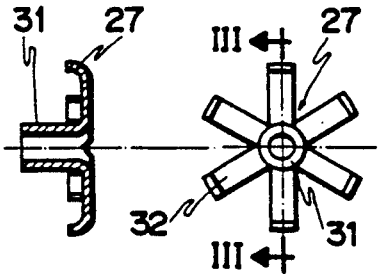
FIG.-15
FIG.-16

CONSTRUCTION OF BUILDINGS

This is a continuation of application Ser. No. 211,583, filed June 27, 1988 now abandoned.

The object of the invention is centred on prefabricated construction, or partial prefabrication, of buildings, using basic panels which are placed in pairs in a parallel manner at a certain distance between the two, in order to form the external structure of a certain building or construction. The said panels are used individually to form the internal walls.

Each of the panels is of the type comprised by a framework of rods to form a rectangular hollow body. The two larger surfaces of the panel make up the basic framework threof, and are joined to each other by means of further rods, which afford greater strength to the assembly. The hollow body is filled with an insulating material, such as expanded polystyrene.

Obviously, the outer surfaces of the internal insulating material lie within the framework, which latter is located externally.

First of all, foundation shoes are placed on a concrete base or cube fixed on the building site, which shoes are provided with a transversal projection which extends upwards at its upper end with two horizontal projections at either side thereof, and two further horizontal projections.

Pairs of panels are placed on each of the upper projections of the concrete shoe, whereas on the lower projections, and on the inside thereof, are placed the beams which form the base of the building and, on the outside thereof, the outer concrete finishing of the building.

The panels are placed in a parallel manner on the upper projections, the non-facing surfaces of the said panels having been previously coated with a layer of concrete to provide two smooth surfaces. During this operation, and prior to the laying of the concrete, special elements for lateral coupling of the panels, which shall be described in detail further on, are likewise provided on the said outer surfaces of the panels.

The panels, with coupling elements already lodged within the concrete-coated surfaced, are arranged to form a horizontal framework over the shoe, each pair of panels being assembled with the aid of rods which maintain the parallel position between the two panels. The said rods are easily introduced through the insulating material of the panels.

The central projection of the shoe in turn receives a circular shaft, corrugated, for example, which extends upwards through the hollow centre of the panels.

The number and arrangement of rods and the circular shafts depend on the general dimensions of the building.

Once the assembly has reached a suitable height, with an appropriate number of panels, concrete is introduced into the hollow cavity between each pair of panels, and the mentioned elements for lateral coupling of the panels are tightened. At the same time concrete is introduced at the base of the shoe and at the coupling areas of the beams.

Once a suitable height is reached, such as, for example, the height of one storey or floor, the foregoing is repeated along the external profile of the building to build a further storey. For this purpose, the beam of this new storey leans on one of the panels of the frame, specifically on the inner panels thereof, and further panels are placed thereon.

The circular shafts located in the hollow cavity between the panels end in handles for coupling to the handles of the circular shafts located in the respective hollow areas of the upper storey.

The holes provided in the mentioned profiles in turn engage cylindrical elements having a peripheral flange which couples to the base of the said profiles. The cylindrical section of the said elements is substantially of the same height as the width of the U-shaped profile.

Each of the said cylindrical elements is provided with two openings which are displaced from the geometrical centre thereof. One of the openings is circular in shape and allows the passage therethrough of the bolt from the panel, the other opening being hexagonal in section.

A workman may act with a spanner on the bushings through the hexagonal apertures in order to fasten the panels together and, once this has been done, the said apertures allow the washer and nuts to be adjusted in order to maintain a constant distance between the two panels during hardening of the inner concrete.

Each of the profiles is provided with two holes. The angular corner profiles are provided with extensions on which the said holes are located in order to engage two panels at an angle.

The profiles may further serve as support for stays to maintain the structure of the building during hardening of the concrete, and may be of a greater length.

In accordance with a varying embodiment of the invention, the said paired panels comprising the outer wall may be substituted by single panels, with a single framework of rods and two layers of insulating material, leaving a hollow cavity therebetween, of variable size, equivalent to that determined by the two paired panels of the preceding embodiment. The rods use in the preceding embodiment are unnecessary herein, and thus assembly is quicker and more accurate.

As regards all other features of the preceding embodiment, such as seating on the shoe, filling with reinforced concrete, etc. these are maintained.

The beam of said upper story are likewise filled with concrete as same is introduced between the panels.

To form the corner closures of the building, the inner panels are cut away in order that the concrete may occupy such spaces.

The compartments or inner walls are formed by single panels filled with layers of concrete, this being done at the factory, which are then coupled to the panels of the outer frame.

Furthermore, the inner walls are coupled to each other by means of single panels which are likewise previously filled with layers of concrete.

In all connections of the panel, a special epoxy adhesive for concrete is used.

To assist in assembly, improve suitable contact between the panels, and achieve the superficial alignment of a certain building, the invention foresees the use of U-shaped angular profiles for inner and outer corners, and straight profiles for smooth surfaces.

The said profiles are provided with holes at their base for fastening to the panels, and, whenever necessary, are additionally provided with lateral extensions, likewise provided with holes, for fastening of other auxiliary elements thereto.

As has already been mentioned hereinbefore, the panel surfaces which were covered with concrete at the factory, are provided with elements for regulating contact and separation between the panels. Those regulating elements consist of bodies having a hollow, cylindrical section with an inner thread, and on the end section with six projections in the shape of a star, which element is embedded in the concrete together with a bolt which is threaded thereto and projects from the concrete layer.

All the mentioned details may be observed in the attached sheets of drawings, wherein the following are shown in an illustrative and non-limiting manner.

FIG. 7 shows a cross section along line I—I of FIG. 6.

FIG. 8 shows a front view of a part of the profile of FIG. 7.

FIG. 9 is a section taken on line II—II of FIG. 8.

FIGS. 10 through 12 show detailed views of assembly of the external profiles.

FIGS. 13 and 14 show a top view and a sectional view of the bushing of the profile assembly of FIG. 7.

FIGS. 15 and 16 show an elevation and plan view, respectively, of the element which is embedded in the panels for lateral coupling thereof.

Figure 1:
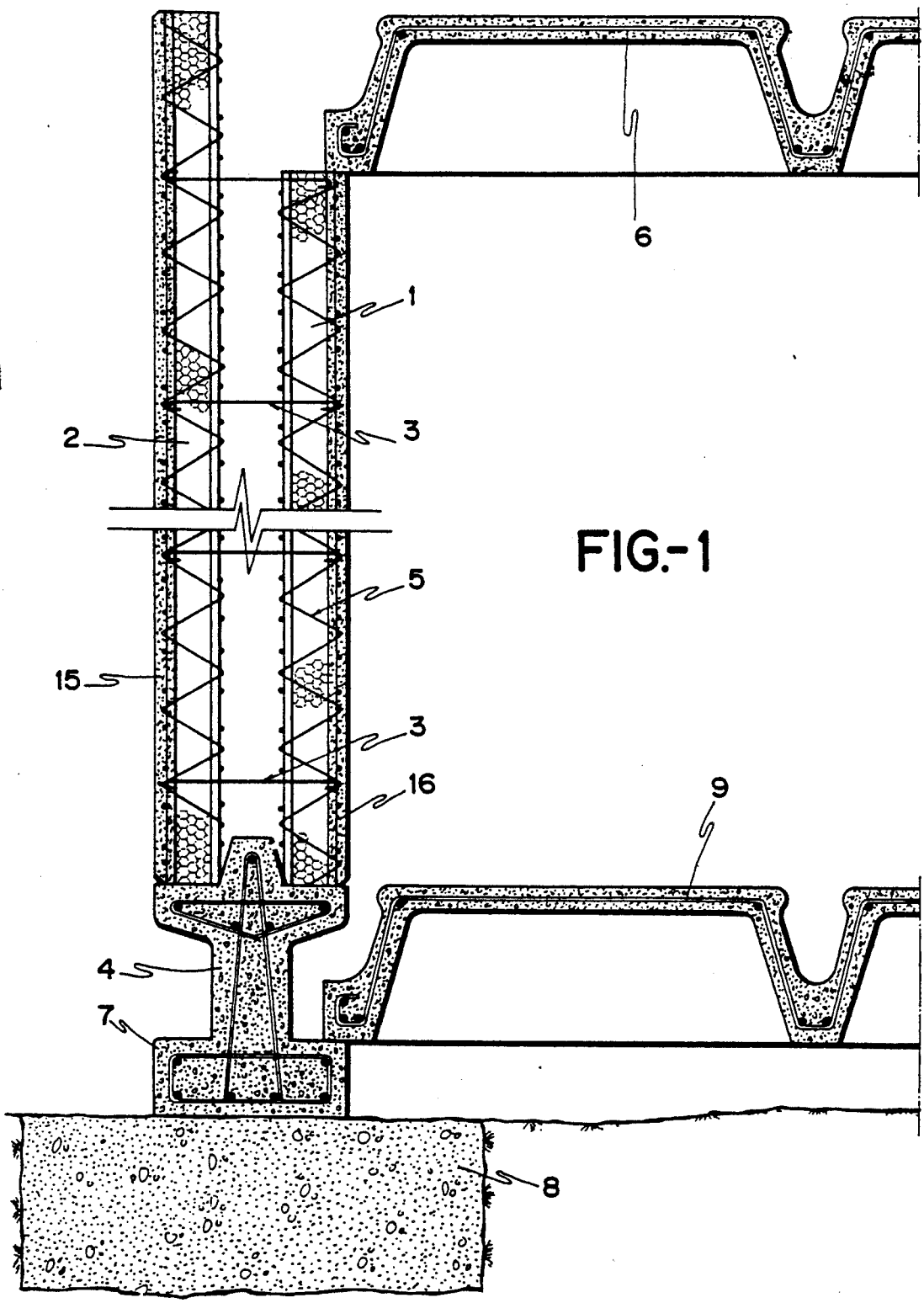
FIG. 1 shows an elevation view of the first stage of assembly in accordance with the invention.

With reference to FIG. 1, it can be observed that panels (1) and (2) are arranged parallel to each other on shoe (4). The external surfaces (16) and (15) of the said panels are coated, in the factory, with a layer of concrete with a thickness of, for example, 2.5 m/m, and the wires of each panel (not referenced) as well as the insulating material contained therein, may be observed.

Each pair of panels is separated by rods (3) which maintain the distance therebetween, the number and position thereof depending on the requirements and dimensions of the panels.

The shoe (4) is placed on the lower cube (8) provided on the building site, and the base (7) of said shoe (4) in turn serves as a support for the beams (9) which engage the lower surface of building plates.

Further beams (6) may be observed on the upper part of the drawings which beams correspond to a second storey of the building, and on the inner panels of the framework.

Figure 2:
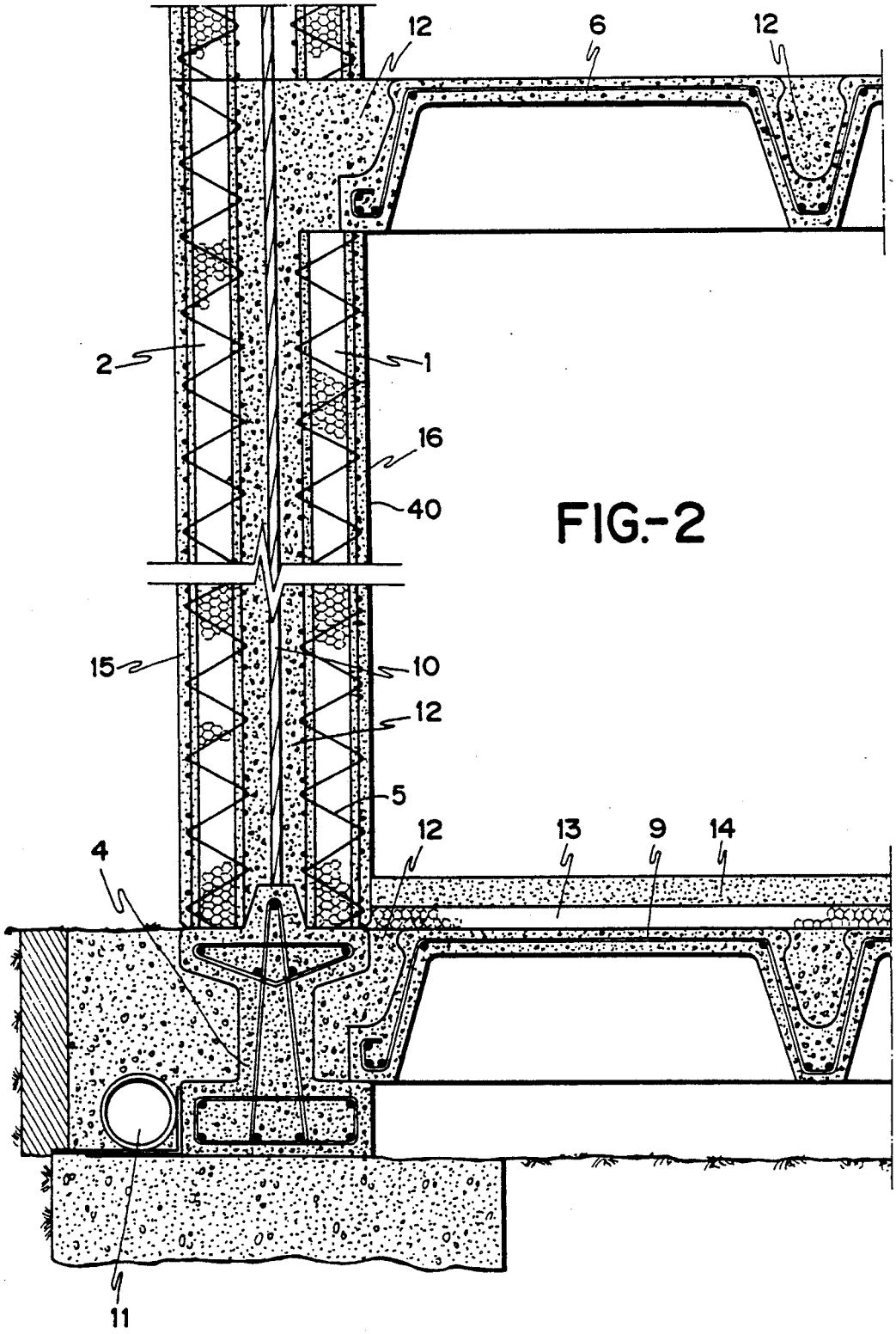
FIG. 2 shows the second stage of the assembly.

Given the above framework of the building, and with reference to FIG. 2, the provision of a circular shaft (10) on shoe (4) can be observed, the mass of concrete being introduced between the panels to keep the circular shaft (10) in a central position. At the same time, concrete (12) is likewise provided on the sides of the shoe (4) and on beam (9). The perimetral drainage system (11) is likewise shown in FIG. 2.

The on-site concrete (12) fills the elevated perimetral hollow, until it reaches the beam (6) of the first storey of the building, which, as can be seen, rests on the inner panel. To aid this arrangement, the panel of this storey is interrupted to house the end of the beam (6).

The circular shaft (10) is interrupted by a handle to engage the next circular shaft as the building progresses. A polystyrene plate (13) and the lower floor (14) which completes the assembly may likewise be observed in FIG. 2.

Figure 3:
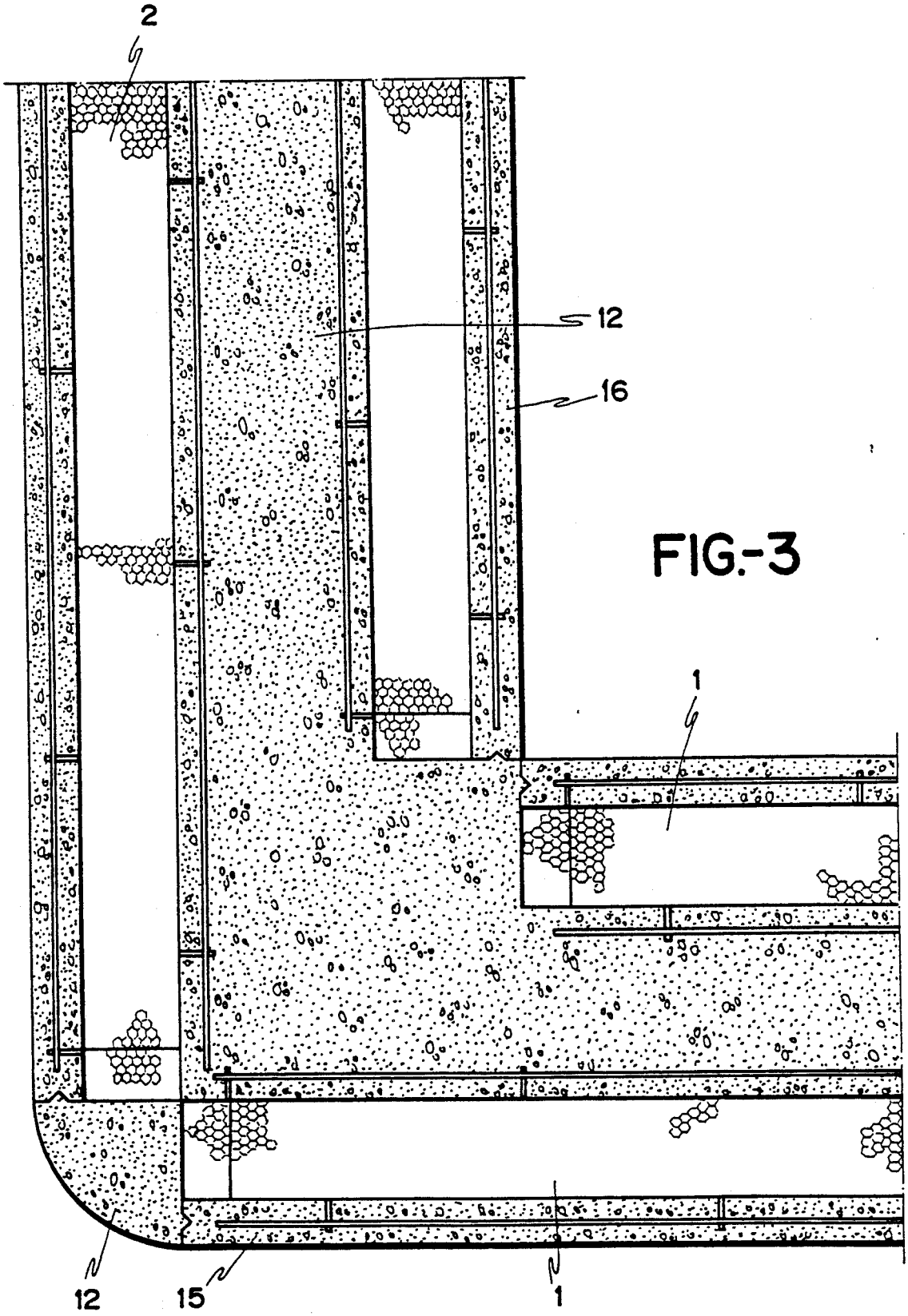
FIGS. 3, 4 and 5 show different manners in which the panels are joined together, in accordance with the invention.
Figure 4:
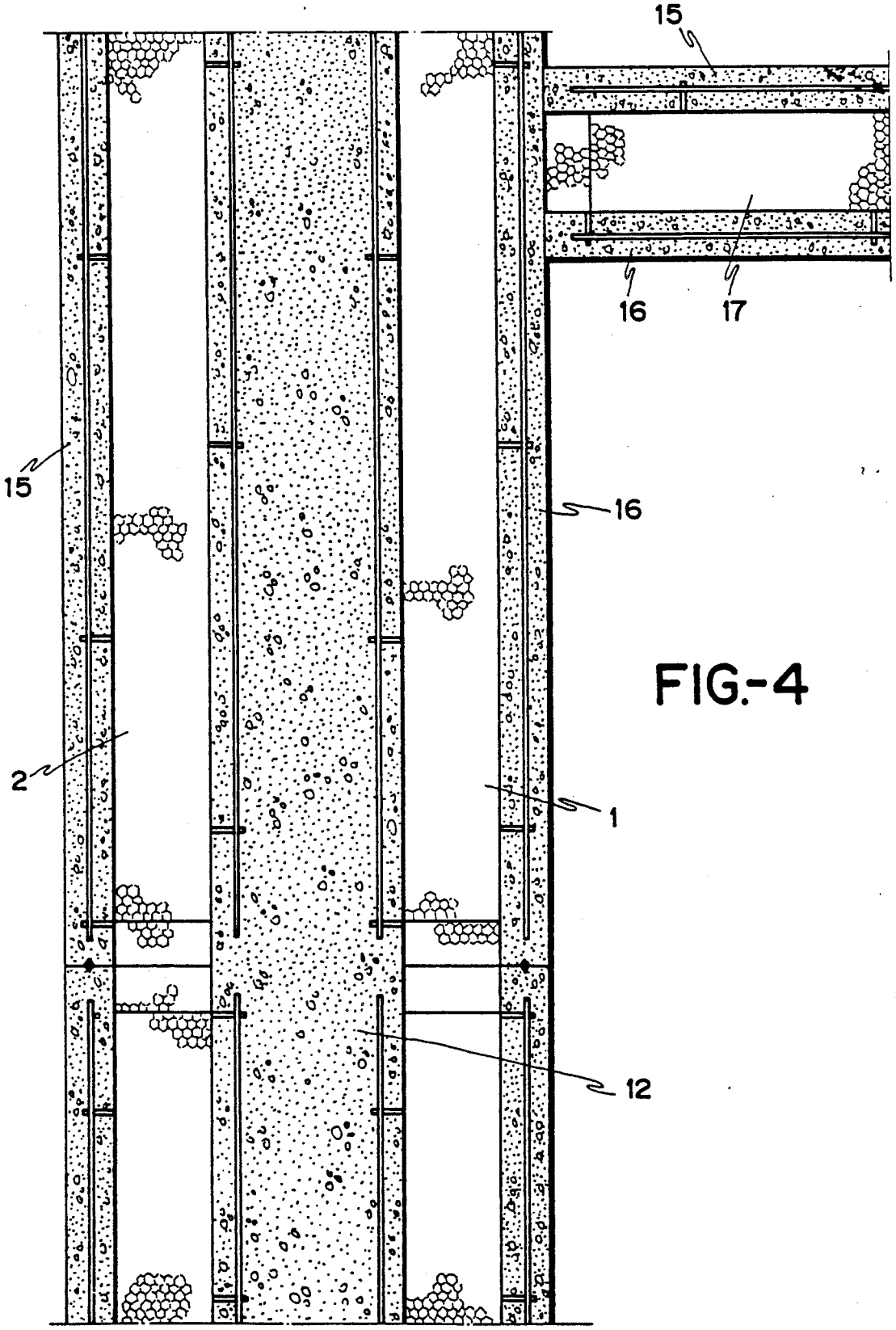
Figure 5:
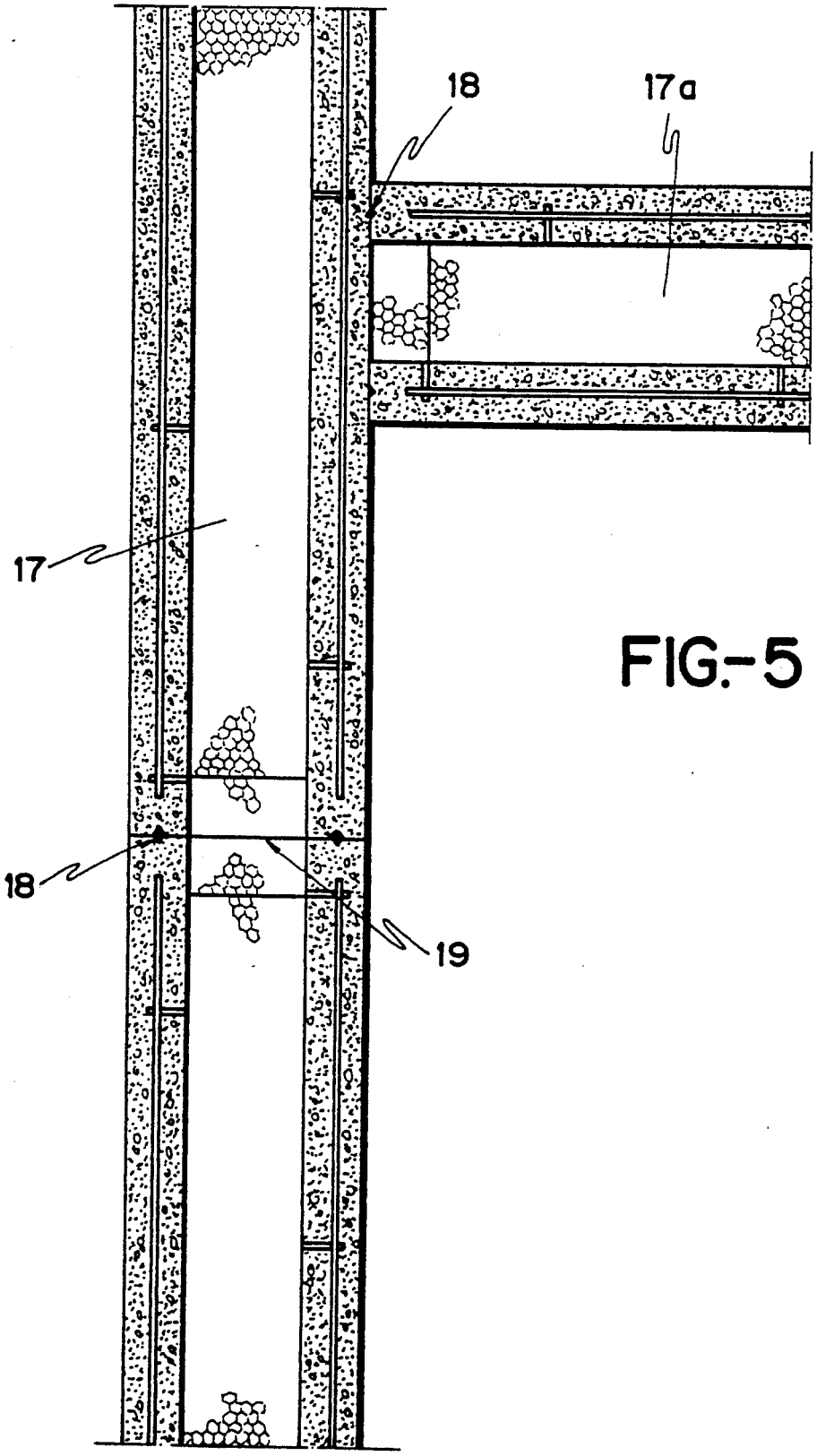

The various stages for coupling between panels are shown in FIGS. 3, 4 and 5. In FIG. 3, for example, an inner corner corresponding to the coupling of two panels (1) is cut away to form the corner, wherein the concrete (12) fills the space cut away and the outer corner.

FIG. 4 shows the coupling between a perimetral frame and an internal panel. Both external walls (15) and (16) of the internal panel (17) are likewise coated in the factory. FIG. 5 shows the coupling between internal panels, for example, between panels (17) and (17*a*). A special epoxy adhesive, which aids coupling, is provided between the sides of panel (17) and between panels (17) and (17*a*).

Figure 6:
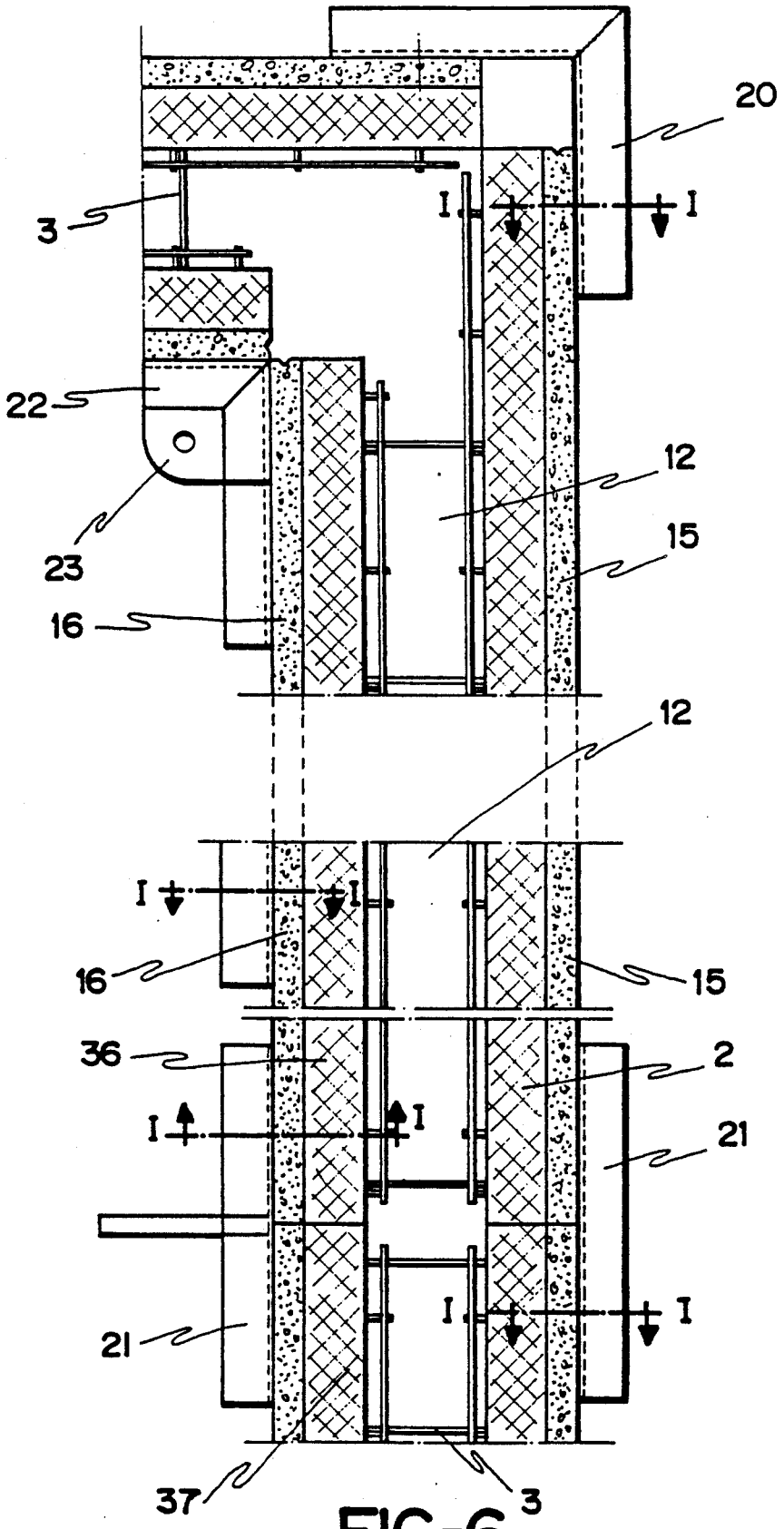
FIG. 6 shows the arrangement for assembly of the external profiles, in accordance with the invention.

With respect to FIG. 6, and with reference to the perimetral frame which is partially shown, external corner profiles (20), internal corner profile (22) and profile (21) should be noted, same being arranged at the neighboring pairs of panels in order to ensure coupling therebetween.

The cross-sections along lines I—I of FIG. 6 are represented in FIG. 7 and show element (27) which is embedded in the mass of concrete (15) provided in the factory. Such elements (27) are arranged near the sides of panels (2), such that profiles (20), (21) and (22) which may be formed as C-shaped sections 24 (FIGS. 7 and 9), are arranged on every two panels, such as, for example, (36) and (37) of FIG. 6, which lie below and above elements (27).

The elements (27) and bolts (26) project from each panel, and profiles (20), (21) and (22) are placed thereon, whilst bushings (25) are arranged in the apertures (33) thereof (FIGS. 13 and 14). Upon receiving bushings (25) in apertures (33), the profiles (20, 21, 22) are placed over every two panels, and the bushings allow bolts (26) to cross same through circular apertures (30) thereof.

In this respect, FIGS. 13 and 14 likewise show the two apertures 29, 30 of bushing (25), which are displaced with respect to the centre. Bushing (25) fits tightly within the aperture (33) of the profiles (20), (21) and (22) such that the blind hexagonal apertures (29) may be acted upon in order to bring adjacent panels (36) and (37) closer to each other (FIG. 6) before definitive tightening of threaded bolt (26).

Profiles (20), (21) and (24) may be provided with extensions or plates, such as (35) and (23) (FIGS. 8, 9, 11 and 12) with openings for receiving auxiliary elements connected to stays which are fixed to the base, in order to hold the complete assembly.

Finally, FIGS. 15 and 16 show element (27) embedded in the panels, and wherein a cylindrical portion (31) and rear projections (32) thereof, may be observed.

Figure 17:
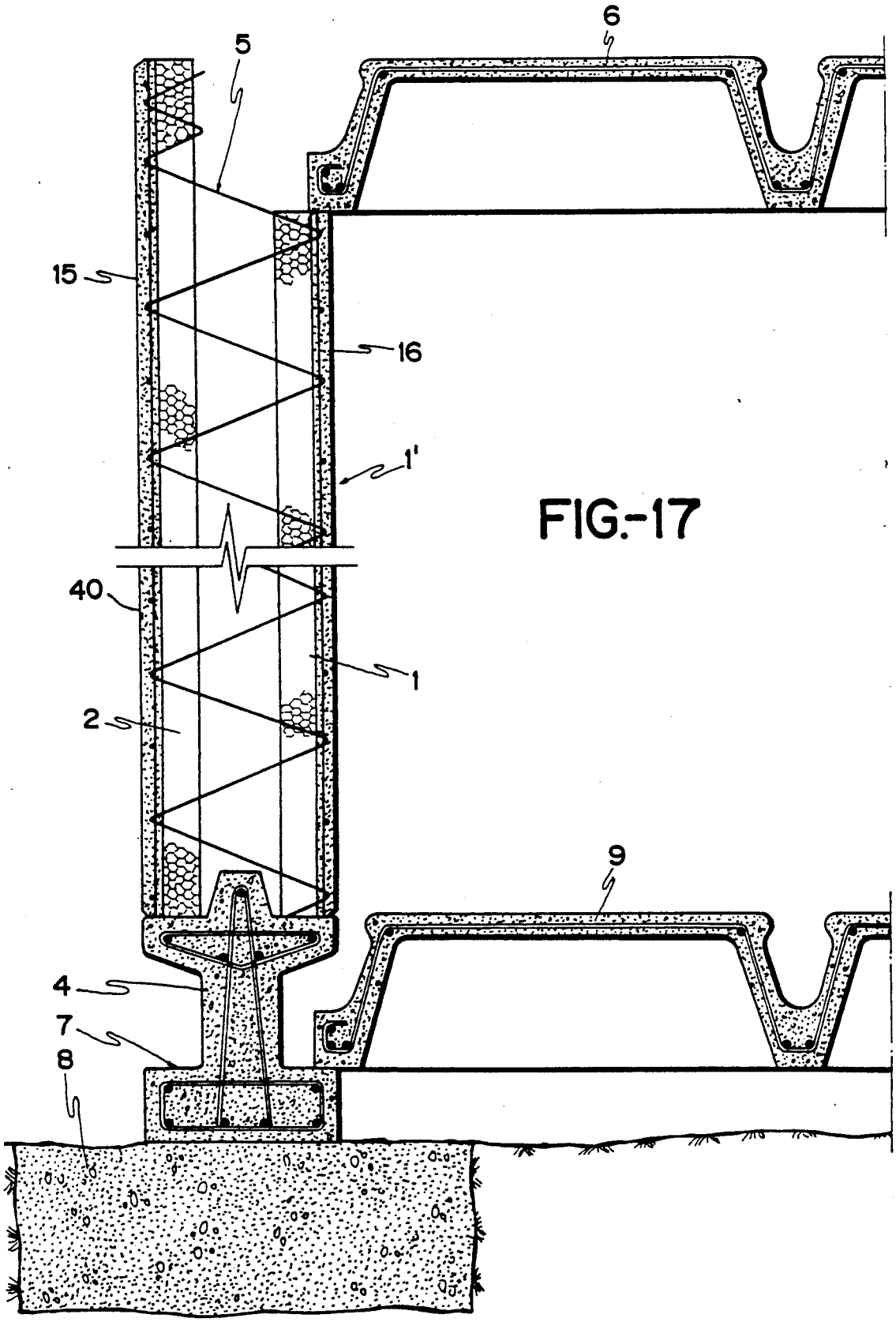
FIGS. 17 and 18 show, in similar views to those of FIGS. 1 and 2, the different embodiment of the invention based on a single panel.
Figure 18:
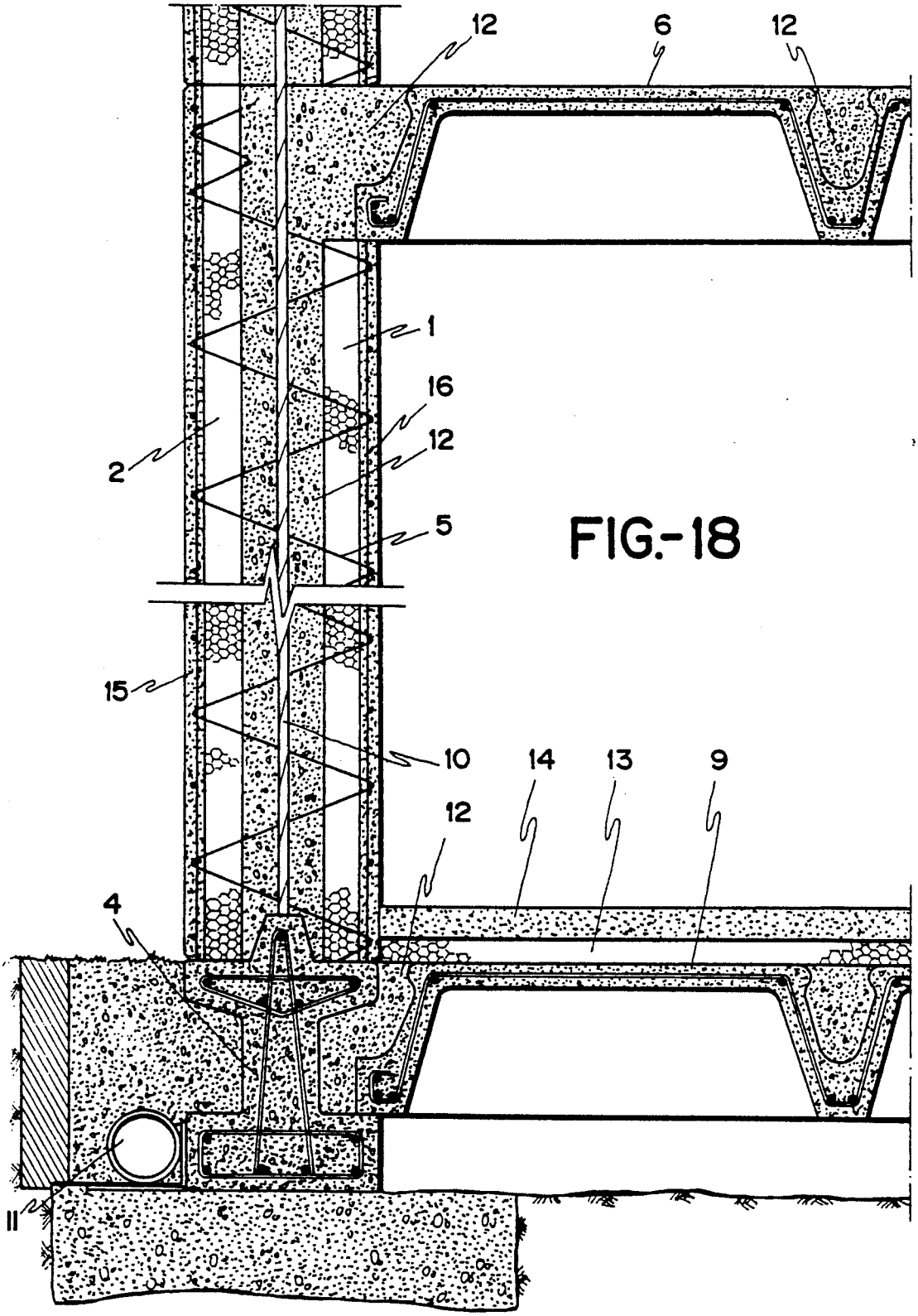

In the varying embodiment of FIGS. 17 and 18, it has been foreseen that each wall or modular wall, of the external structure is comprised by a single panel 1', arranged on the same shoe (4), and comprised by the same two thermally insulating layers 1 and 2, provided on their external surfaces with coatings 15 and 16 of concrete reinforced with respective trusses 40, but with the particularity that trusses are joined to each other by means of single rod structure 5, which obviously crosses the inner hollow of the panel, thereby coupling and stiffening the two halves thereof, wherefore in this case rods 3 of the front embodiment are not required.

Apart from this single panel structure of the wall modulus, the remaining structural features are the same as those of the preceding embodiment.

The essential advantages afforded by the invention over traditional techniques are obvious; for the cost thereof is considerably lower than that of conventional constructions, both as a result of the materials used and of the quickness in assembly. In turn, insulation is total from both the outside and the inside of the building, for both surfaces have insulating properties. A greater soundproofing is likewise obtained, this being important for good habitability.

We claim:

1. Improvements in the construction of buildings, comprising prefabricated panel structures provided with insulating material and having external walls (15, 16), said panel structures including panels (1, 2) arranged in pairs and the panels (1, 2) of each pair being in parallel with each other and positioned at a predetermined distance therebetween; means (3) for maintaining relative parallel position of said panels; means (4) for supporting and coupling said panels to a base (9) of a building; a plurality of means (20, 21, 22) for coupling said panel structures with each other; means (12, 6; 12, 9) for coupling said panels to a storey of a building immediately above or below a storey formed of said panel structures, said panels in each pair defining therebetween a hollow space filled with concrete constituting a connecting element to couple the panels of each pair to each other whereby said panels in each panel structure serve as a container for said concrete to provide a stable assembly to simultaneously form an internal and an external structure of the building, said means (20, 21, 22) for coupling said panel structures each including a profile element (20, 21, 22) attached to an external wall of a panel and a connecting member (27) totally embedded in a respective external wall made of concrete, said connecting member having a base portion (32) a threaded cylindrical portion (31) which projects at right angles from said base portion towards an outer face of said panel, said cylindrical portion being accessible from an outside of the panel through a hole provided in each panel at said element, and fastening means (26) received in said cylindrical portion.

2. Improvements in the constructions of buildings in accordance with claim 1, wherein said profile element is an angular profile (20, 22) arranged on two neighboring panels of adjacent panel structures, said angular profile being provided with a hole (33) which corresponds to said hole provided in the respective panel, each profile element of said coupling means further including a bushing (25) received in said hole of said profile, each bushing having two apertures, one of said apertures receiving a bolt (26) of said fastening means which engages in said threaded cylindrical section and another aperture being hexagonal for the introduction thereinto of a tool for bringing the panels closer to each other before tightening said bolt, the apertures of each bushing being offset with respect to a center thereof.

3. Improvements in the constructions of buildings in accordance with claim 1, wherein said means for supporting and coupling said panels to a base of a building comprise foundation shoes (4) and vertical metal bars (40) which are supported on said shoes, said metal bars extending through the hollow space between the panels in each panel structure.

4. Improvements in the constructions of buildings in accordance with claim 3, wherein each foundation shoe has a lower section which supports an end of a prefabricated beam (9) of the construction, each beam having an upper surface located at a level of a face of the foundation shoe on which panels of a panel structure are arranged.

5. Improvements in the constructions of buildings in accordance with claim 4, wherein further beams (6) are provided for intermediate storeys of the construction, said further beams being coupled to a wall of a panel of a panel structure by concrete.

* * * * *